US010804054B1

(12) United States Patent
Chu

(10) Patent No.: US 10,804,054 B1
(45) Date of Patent: Oct. 13, 2020

(54) MULTIFUNCTIONAL PUSH KNOB

(71) Applicant: Ching-Hsiung Chu, New Taipei (TW)

(72) Inventor: Ching-Hsiung Chu, New Taipei (TW)

(73) Assignee: Ching-Hsiung Chu, New Taipei (TW)

( * ) Notice: Subject to any disclaimer, the term of this patent is extended or adjusted under 35 U.S.C. 154(b) by 0 days.

(21) Appl. No.: 16/724,201

(22) Filed: Dec. 21, 2019

(30) Foreign Application Priority Data

Nov. 22, 2019 (TW) ..... 108142463 A

(51) Int. Cl.

| | |
|---|---|
| ***H01H 25/06*** | (2006.01) |
| ***G05G 1/02*** | (2006.01) |
| ***H01H 13/705*** | (2006.01) |
| ***H01H 19/14*** | (2006.01) |
| ***G05G 1/10*** | (2006.01) |

(52) U.S. Cl.
CPC ..... *H01H 25/06* (2013.01); *G05G 1/02* (2013.01); *G05G 1/10* (2013.01); *H01H 13/705* (2013.01); *H01H 19/14* (2013.01); *H01H 2019/143* (2013.01)

(58) Field of Classification Search
CPC ..... H01H 25/06; H01H 13/705; H01H 13/72; H01H 19/14; H01H 19/20; H01H 25/041; G01G 1/02; G01G 1/10; G06F 3/0362; H03K 17/78
See application file for complete search history.

(56) References Cited

U.S. PATENT DOCUMENTS

| | | | | |
|---|---|---|---|---|
| 7,109,469 | B2 * | 9/2006 | Hayashi | H01H 25/06 200/564 |
| 2005/0224322 | A1 * | 10/2005 | Kikuya | H01H 25/06 200/11 R |
| 2010/0147665 | A1 * | 6/2010 | Huang | H01H 3/20 200/336 |
| 2010/0270133 | A1 * | 10/2010 | Baker | H01H 25/041 200/4 |
| 2012/0055763 | A1 * | 3/2012 | Chou | H01H 25/065 200/4 |
| 2013/0032456 | A1 * | 2/2013 | Nakajima | H01H 19/005 200/336 |
| 2013/0220779 | A1 * | 8/2013 | Kerner | H01H 19/11 200/4 |
| 2014/0072294 | A1 * | 3/2014 | Himeno | H03K 17/78 396/543 |
| 2015/0150646 | A1 * | 6/2015 | Pryor | G06F 3/039 345/174 |

* cited by examiner

*Primary Examiner* — Kyung S Lee

(57) ABSTRACT

The present invention provides a multifunctional push knob, comprising a base; a rotating output element, rotated in clockwise or counterclockwise direction and outputting signals; a connecting socket, fixed on the base and having a pressing signal generating unit and a plurality of infrared shielding induction signal generating units; a fixing frame, fixed on the base; a pressing socket, disposed on the fixing frame so as to be able to move up and down and pushed against the pressing signal generating unit; a display unit, fixed on the pressing socket; a keycap, correspondingly placed on the pressing socket and rotated; and a controlling knob element, fixed on the keycap and having a signal shielding member inserted into infrared shielding induction signal generating units; wherein when controlling knob element is rotated, an infrared signal of the infrared shielding induction signal generating units is intermittently transmitted.

4 Claims, 7 Drawing Sheets

MULTIFUNCTIONAL PUSH KNOB

FIELD OF INVENTION

The present invention relates to a multifunctional push knob. In particular, it relates to an integrated switch having a function of displaying information and different control modes of pushing and rotating, thereby producing multiple control signals.

BACKGROUND OF THE INVENTION

In all kinds of electronic products, it is often seen that the function is activated and controlled through a control button to generate a signal. The specifications and sizes of the switches are very diverse, and the field of application is quite wide.

The switches commonly used by general precision equipment, small equipment or small appliances are generally opened and closed by pressing, or through knob-type switch button. Although both of them have their application advantages, a switch usually only outputs one signal and its application is also limited. If a multi-functional device is controlled by a switch, it is necessary to integrate multiple sets of control switch modules on a control panel, and each of them can control different functions.

In addition, in the case of a conventional push-button switch or a knob-type switch, since it does not have a display function, an additional display must be used.

In terms of integrated applications, if only a single switch device is used to achieve functions that include displaying menus, switching menus, selecting function items, determining function items, etc., and achieve the integration of multiple functions, it is almost impossible. It's a bottleneck in the existing technology.

In summary, the inventor of the present invention contemplates and designs multifunctional push knob to improve the lack of the conventional technology, thereby enhancing the implementation and utilization of the industry.

The above information disclosed in this section is only for enhancement of understanding of the background of the described technology and therefore it may contain information that does not form the prior art that is already known to a person of ordinary skill in the art.

SUMMARY OF THE INVENTION

In view of the above-mentioned deficiencies of the conventional technology, the present invention is to design a multifunctional push knob with patentability, novelty and industrial utilization, to overcome the difficulties of the conventional technology.

The present invention provides a multifunctional push knob, comprising: a base, including a base plate, an annular conducting member disposed on the base plate, a center of the annular conducting member is a rotation axis, the annular conducting member having an extended conducting pin extended to an outside of the base, a side conducting element is set on both sides of the annular conducting element, wherein the side conducting element has a side extension conducting pin extended to the outside of the base, wherein the base further comprises a tension spring; a rotating output element, including a main rotation frame, the main rotation frame being a tubular member and correspondingly disposed above the base, and rotated around the axis of rotation, a rotation collar extended outwardly and fixed on the main rotation frame, a spring transmission member disposed at a bottom of the main rotation frame, the spring transmission member corresponding to the tension spring and being reset by a feedback force of the tension spring after the main rotation frame being rotated, a conducting contact member is disposed at the bottom of the main rotation frame, the conducting contact member has a first conducting pin and a second conducting pin, wherein the first conducting pin is abutted upon the annular conducting member, and the second conducting pin contacts with the side conducting element after the main rotation frame is rotated, thereby making the extended conducting pin conduct to the side extension conducting pin; a connecting socket, including a connecting base, an upper socket, and a circuit board assembly, wherein the connecting base is fixed on the base plate, the upper socket is fixed above the connecting base, the circuit board assembly is correspondingly fixed to an upper wall surface of the upper socket, and the circuit board assembly has a pressing signal generating unit and a plurality of infrared shielding induction signal generating units, wherein the pressing signal generating unit protrudes on the circuit board assembly and has a resilient returning force, the pressing signal generating unit contacts with the circuit board assembly after pushing the pressing signal generating unit, then a control signal is generated, and the plurality of infrared shielding induction signal generating units comprise an infrared receiving end and an infrared transmitting end which are separated and set correspondingly from each other; a fixing frame, correspondingly fixed above the upper socket, wherein the fixing frame is tubular and has a plurality of sliding guide pieces at a center of the fixing frame; a pressing socket, disposed on the sliding guide piece so as to be able to move up and down, and the pressing socket having a pressing portion which is pushed against the pressing signal generating unit; a display unit, fixed on the pressing socket and electrically connected to the circuit board assembly; a keycap, correspondingly placed on the pressing socket and rotated around the rotation axis, a transparent plate corresponded to the display unit and disposed on the keycap, wherein when the keycap is pressed, the pressing socket is moved downwardly by the keycap, and then the pressing signal generating unit is pressed to generate a control signal; and a controlling knob element, including a finger-actuated ring, an outer ring sleeve, and a signal shielding member, wherein the finger-actuated ring is a ring-shaped sheet structure that is fixed above the keycap, the outer ring sleeve is a ring-shaped pipe, an upper end of the outer ring sleeve is correspondingly fixed to the keycap, and is correspondingly set on an outer ring of the fixing frame, the signal shielding member is a ring-shaped pipe, inserted between the outer ring sleeve and the fixing frame, and fixed on the outside ring sleeve, a under wall surface of the signal shielding member further extends into and between each group of the infrared receiving end and the infrared transmitting end, and a plurality of hollow portions are distributed in a ring-shape structure below the signal shielding member, when the controlling knob element is rotated, an infrared signal between the infrared receiving end and the infrared transmitting end is intermittently transmitted.

In the embodiment of the present invention, the base comprises a first rotation limited element, the main rotation frame comprises a second rotation limited element, and the main rotation frame is abutted upon the first rotation limited element after the main rotation frame is rotated toward a rotation angle in the clockwise or counterclockwise direction, thereby limiting a rotation range of the main rotation frame.

In the embodiment of the present invention, the fixing frame has a plurality of elastic pushing pieces on an outer wall surface of the fixing frame, and the elastic pushing piece protrudes from the outer wall surface of the fixing frame; a plurality of segmented projections is disposed around and on an inner ring wall surface of the signal shielding member, and each of the segmented projection is distributed at an equal angle and is pushed by the elastic pushing piece, when the controlling knob element is rotated, the elastic pushing piece intermittently receives resistance feedback by moving the segmented projections, and multiple segmented feedback forces are generated.

In the embodiment of the present invention, the finger-actuated ring comprises a finger-actuated groove.

The multifunctional push knob of the present invention has a display function on a switch device, and it also provides a pressing signal, a quantifiable left and right rotary control signal, and a left and right rotary control signal of the rotating output element on the switch device. It is a highly integrated control device. For example, it can be used as a quantifiable left and right rotary control signal or selecting function options on a menu. It also can be used to skip to next page or return to previous page by rotating the rotating output element in right or left direction, thereby achieving multifunctional operation modes.

If this device is installed in the car, it can be used as the operation switch of heating and cooling, audio, broadcasting, Bluetooth connection and other equipment. In a fixed space, it would improve the operation functionality and flexibility and allow various controls in the car. The interface can greatly reduce the space, which is non-obvious over the conventional technology.

Many of the attendant features and advantages of the present invention will become better understood with reference to the following detailed description considered in connection with the accompanying drawings.

BRIEF DESCRIPTION OF THE DRAWINGS

The detailed structure, operating principle and effects of the present invention will now be described in more details hereinafter with reference to the accompanying drawings that show various embodiments of the present invention as follows.

DETAILED DESCRIPTION OF THE PREFERRED EMBODIMENTS

Figure 1:
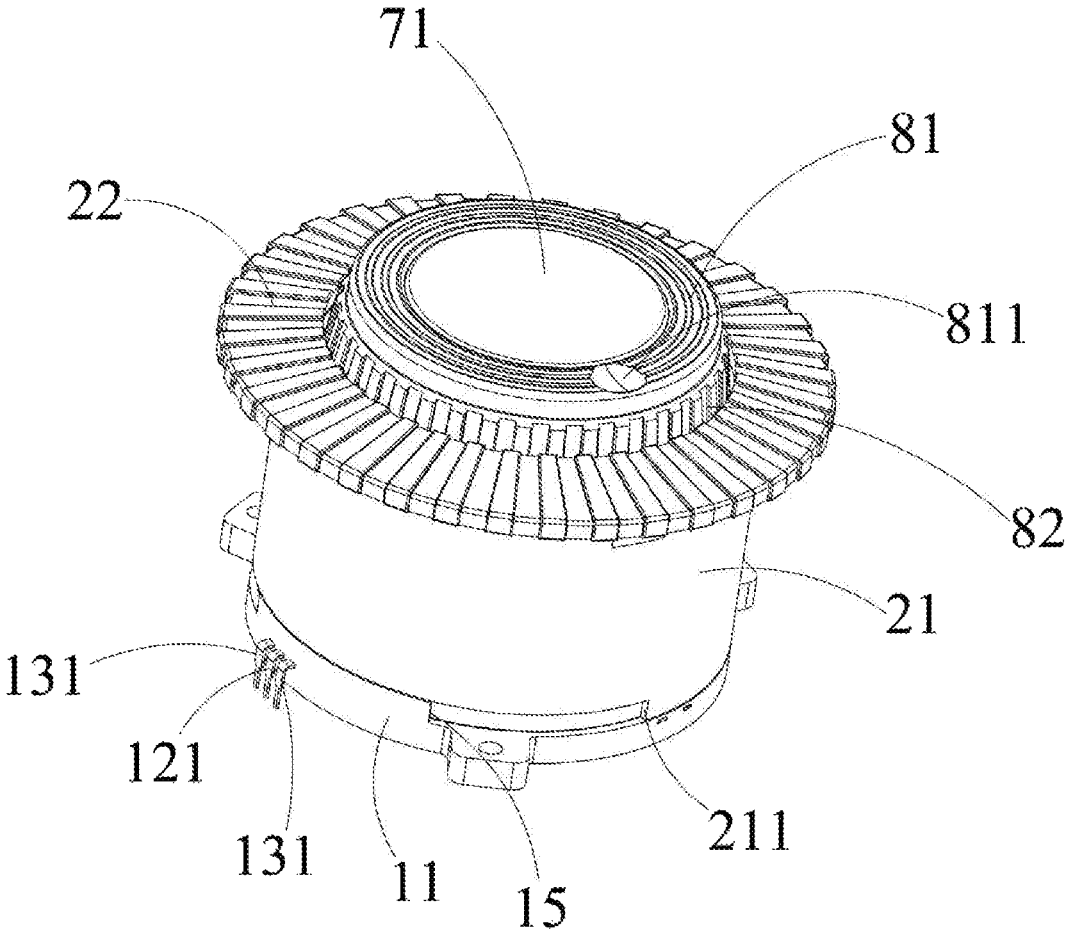
FIG. 1 is an appearance diagram of a multifunctional push knob in the present invention.
Figure 2:
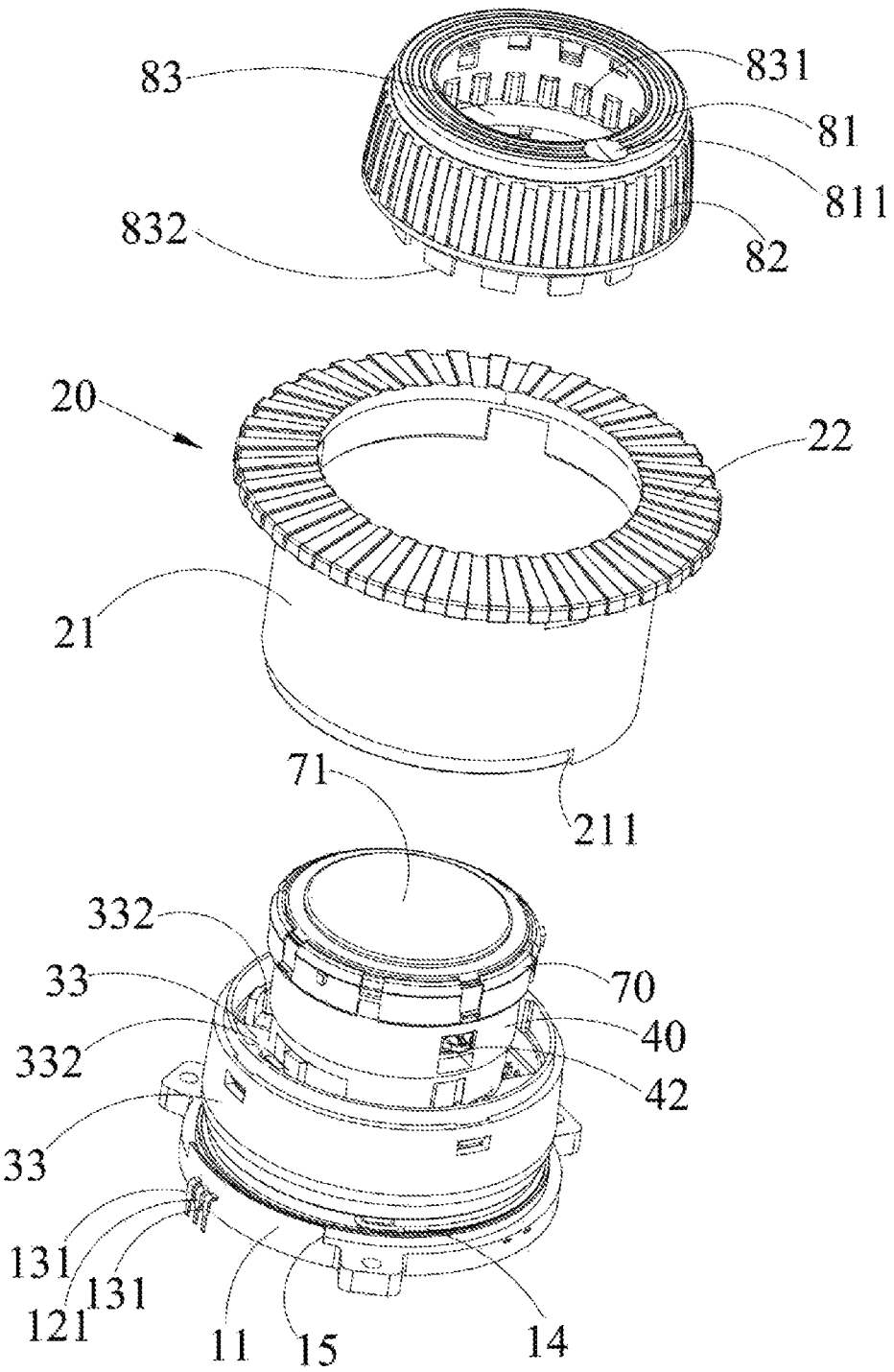
FIG. 2 is an exploded diagram of the multifunctional push knob in the present invention.
Figure 3:
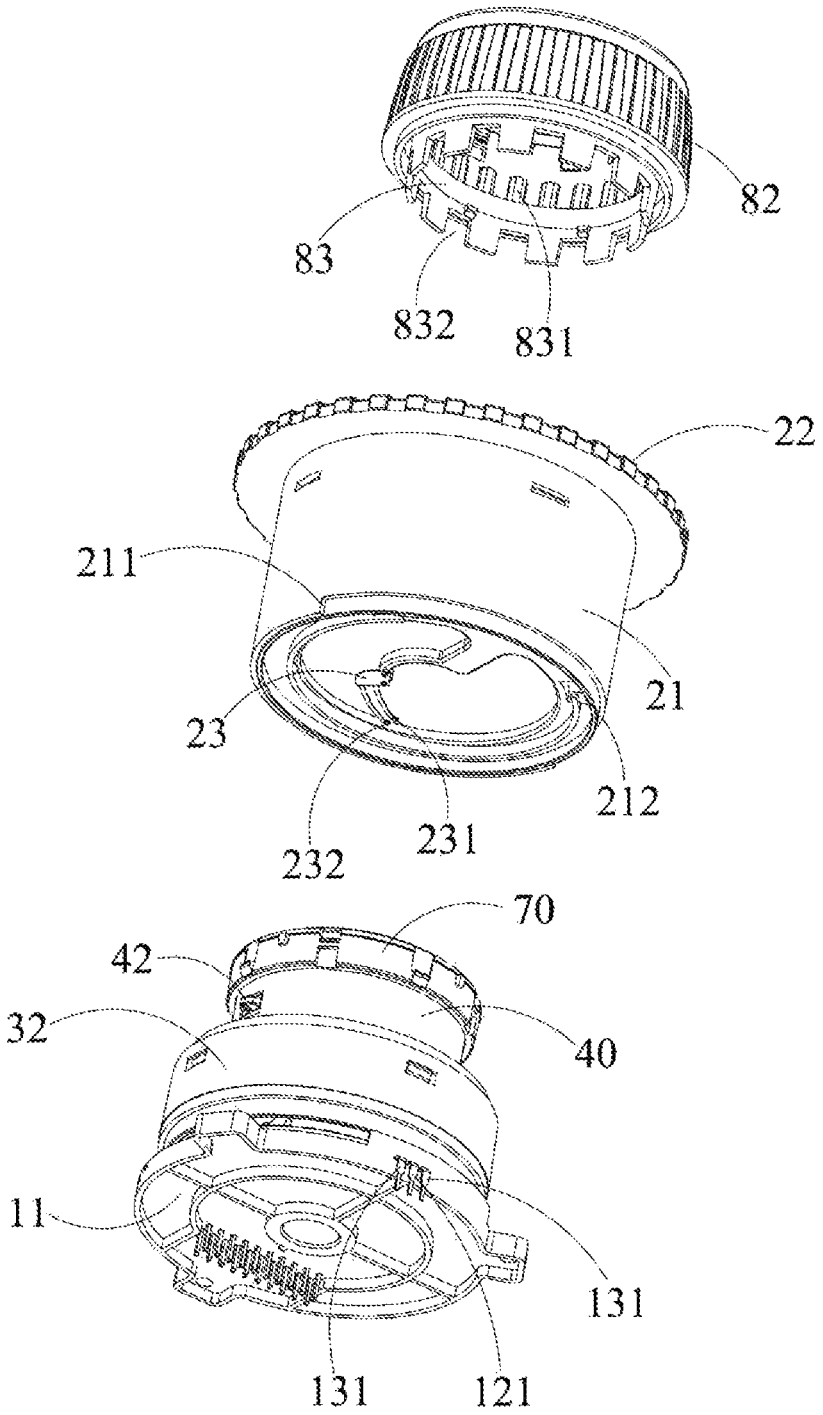
FIG. 3 is another exploded diagram in different angel of view of the multifunctional push knob in the present invention.
Figure 4:
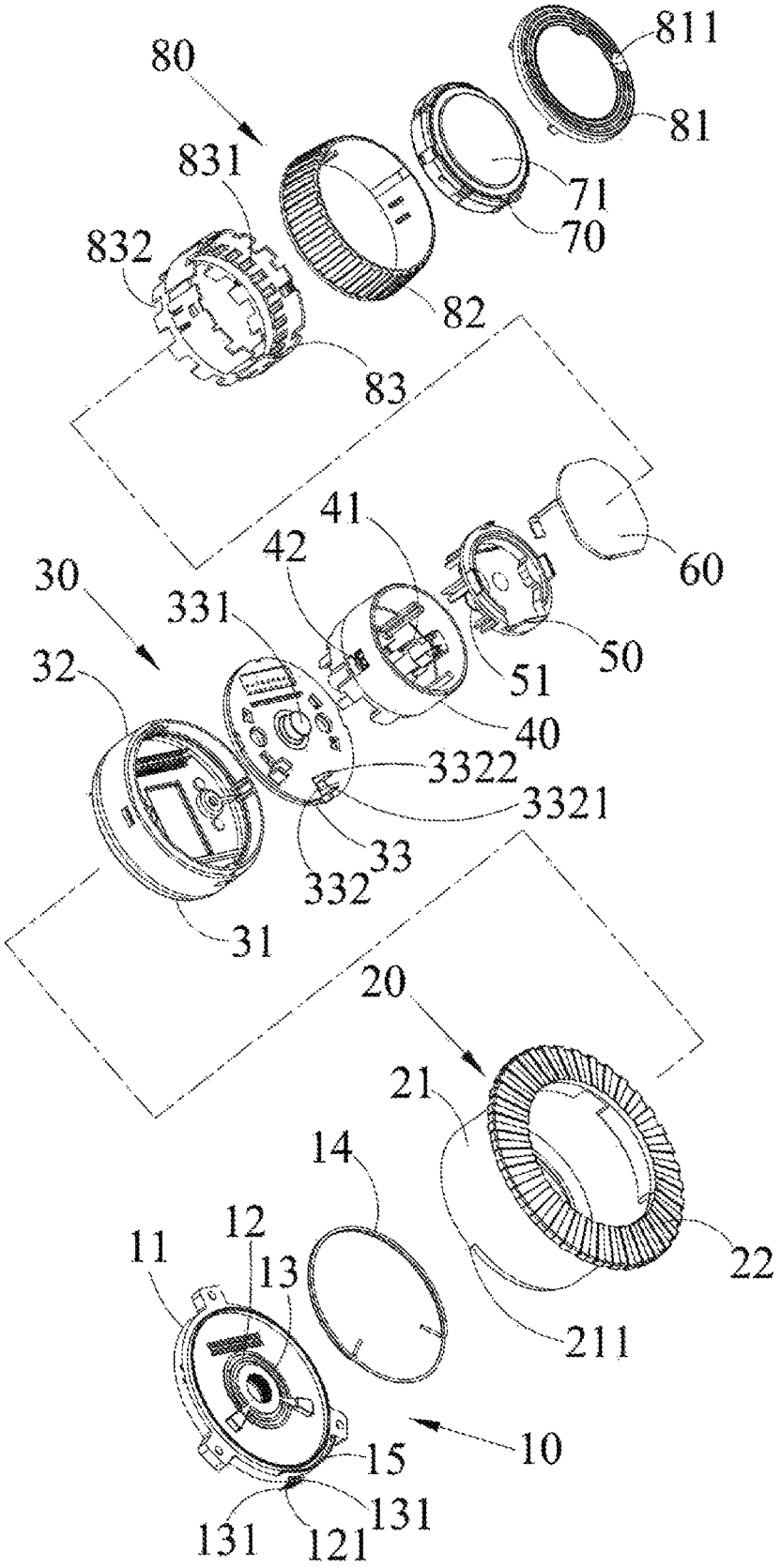
FIG. 4 is an exploded diagram for some elements of the multifunctional push knob in the present invention.
Figure 5:
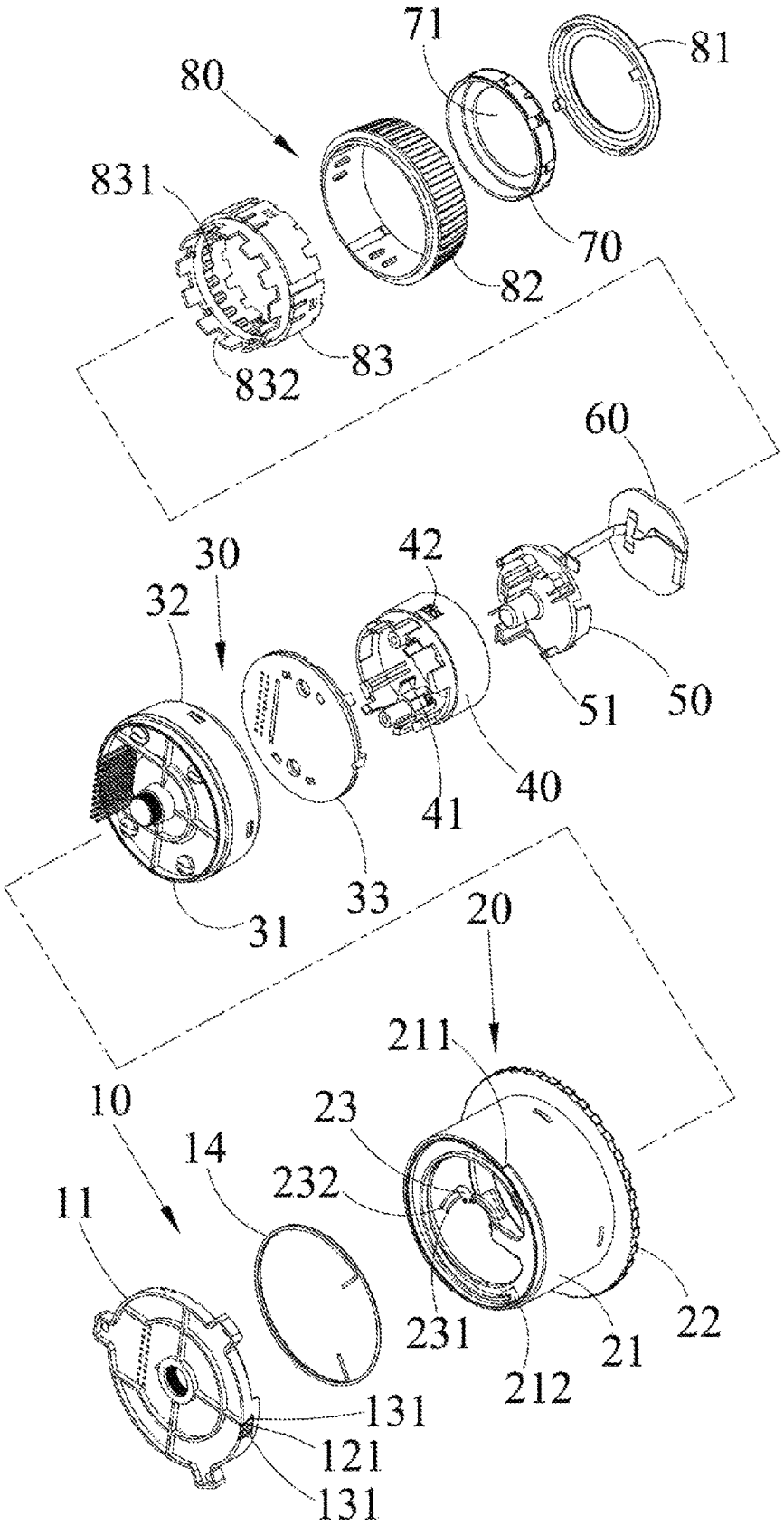
FIG. 5 is another exploded diagram in different angel of view for some elements of the multifunctional push knob in the present invention.

Reference will now be made in detail to the exemplary embodiments of the present invention, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this invention will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way.

For convenience, certain terms employed in the specification, examples and appended claims are collected here. Unless defined otherwise, all technical and scientific terms used herein have the same meaning as commonly understood by one of the ordinary skill in the art to which this invention belongs.

Various embodiments will now be described more fully with reference to the accompanying drawings, in which illustrative embodiments are shown. The inventive concept, however, may be embodied in various different forms, and should not be construed as being limited only to the illustrated embodiments. Rather, these embodiments are provided as examples, to convey the inventive concept to one skilled in the art. Accordingly, known processes, elements, and techniques are not described with respect to some of the embodiments.

The singular forms "a", "and", and "the" are used herein to include plural referents unless the context clearly dictates otherwise.

The following descriptions are provided to elucidate the process of preparing a multifunctional push knob and to aid it of skilled in the art in practicing this invention. These examples are merely exemplary embodiments and in no way to be considered to limit the scope of the invention in any manner.

Please refer to FIG. 1 to FIG. 7, the present invention provides a multifunctional push knob, comprising a base 10, a rotating output element 20, a connecting socket 30, a fixing frame 40, a pressing socket 50, a display unit 60, a keycap 70, and a controlling knob element 80.

The base 10 includes a base plate 11, and an annular conducting member 12 is disposed on the base plate 11. A center of the annular conducting member 12 is a rotation axis, and the annular conducting member 12 has an extended conducting pin 121 extended to an outside of the base 10; and a side conducting element 13 is set on both sides of the annular conducting element 12, wherein the side conducting element 13 has a side extension conducting pin 131 extended to the outside of the base 10; wherein a tension spring 14 is further set on the base 10, and the tension spring 14 is able to provide feedback force in the direction of rotation. At least one first rotation limited element 15 is disposed on the base 10.

Figure 6:
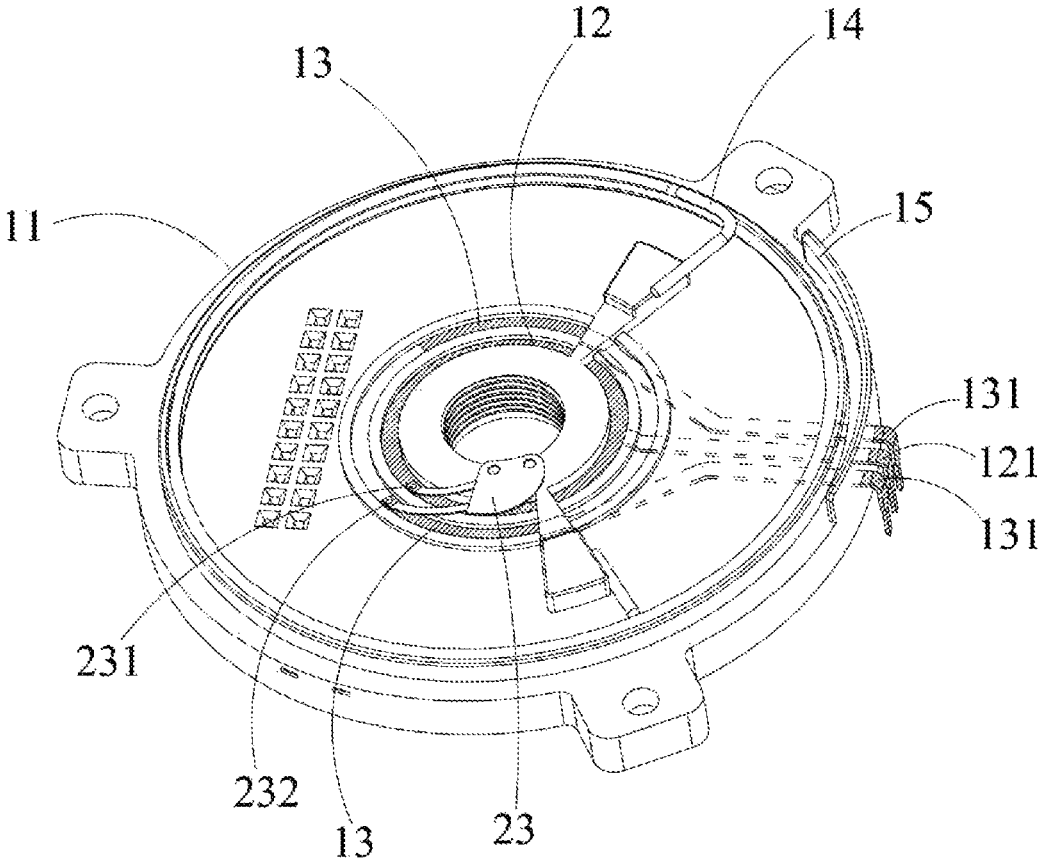
FIG. 6 is a partial appearance diagram of the multifunctional push knob in the present invention.
Figure 7:
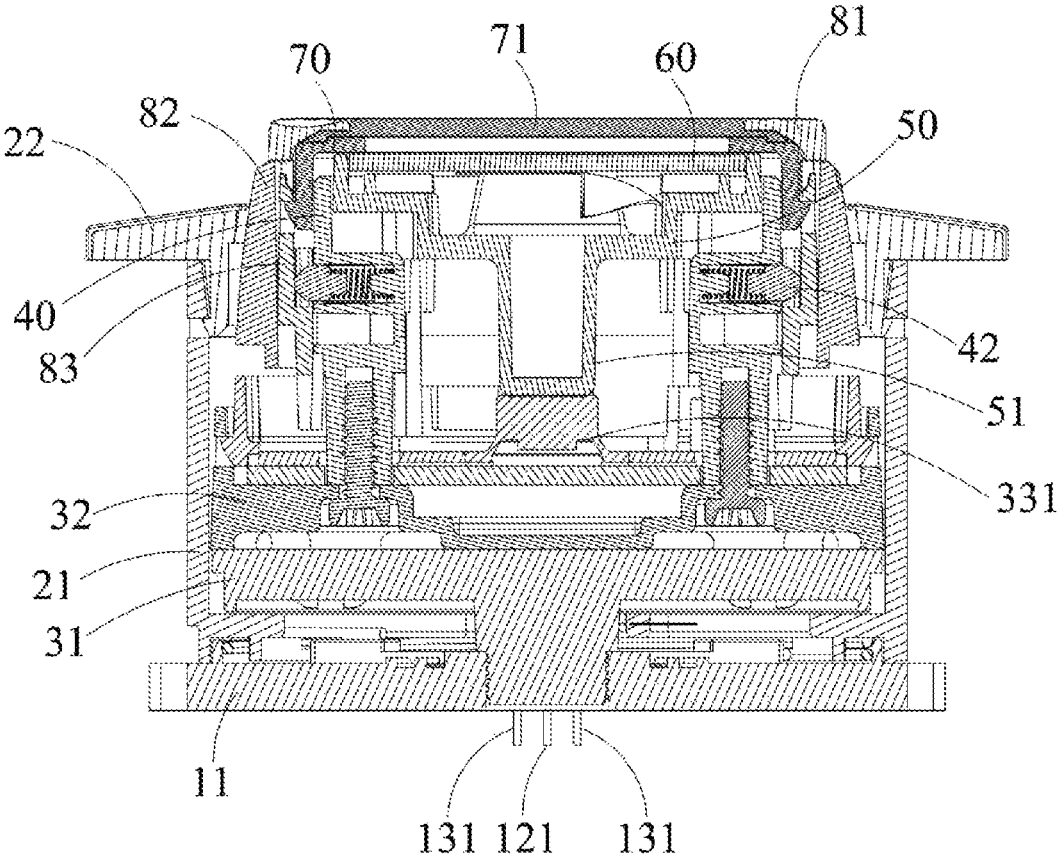
FIG. 7 is a sectional diagram of the multifunctional push knob in the present invention.

The rotating output element 20 includes a main rotation frame 21. The main rotation frame 21 is a tubular member and is correspondingly disposed above the base 10, and can be rotated around the axis of rotation. A rotation collar 22, which is outwardly extended, is disposed and fixed on the main rotation frame 21, and the main rotation frame 21 has at least one second rotation limited element 211. The main rotation frame 21 is abutted upon the first rotation limited element 15 after the main rotation frame 21 is rotated toward a rotation angle in the clockwise or counterclockwise direction, thereby limiting a rotation range of the main rotation frame 21. The rotation angle may be 45 degrees or 90 degrees. In addition, at least one spring transmission member 212 is disposed at a bottom of the main rotation frame 21. The spring transmission member 212 corresponding to the tension spring 14 is reset by a feedback force of the tension spring 14 after the main rotation frame 21 is rotated. In addition, a conducting contact member 23 is disposed at the bottom of the main rotation frame 21. The conducting contact member 23 has a first conducting pin 231 and a second conducting pin 232, wherein the first conducting pin 231 is abutted upon the annular conducting member 12, and the second conducting pin 232 contacts with the side conducting element 13 after the main rotation frame 21 is rotated, thereby making the extended conducting pin 121 conduct to the side extension conducting pin 131. As a result, the rotating output element 20 rotating in clockwise or counterclockwise direction can be determined. The control signals outputted as shown in FIG. 6, it depends on the second conducting pin 232 contacting one of the two side conducting elements 13.

The connecting socket 30 includes a connecting base 31, an upper socket 32, and a circuit board assembly 33. The connecting base 31 is fixed on the base plate 11. The upper socket 32 is fixed above the connecting base 31. The circuit board assembly 33 is correspondingly fixed to an upper wall surface of the upper socket 32, and has connection pins for signal transmission. The circuit board assembly 33 has a pressing signal generating unit 331 and a plurality of infrared shielding induction signal generating units 332; wherein the pressing signal generating unit 331 protrudes on the circuit board assembly 33 and has a resilient returning force. The pressing signal generating unit 331 can contact with the circuit board assembly 33 after pushing the pressing signal generating unit 331, and then a control signal is generated. The infrared shielding induction signal generating unit 332 has an infrared receiving end 3321 and an infrared transmitting end 3322 which are separated and set correspondingly from each other.

The fixing frame 40 is correspondingly fixed above the upper socket 32. The fixing frame 40 is tubular and has a plurality of sliding guide pieces 41 at a center of the fixing frame 40. The fixing frame 40 has a plurality of elastic pushing pieces 42 on an outer wall surface of the fixing frame 40, and the elastic pushing piece 42 protrudes from the outer wall surface of the fixing frame 40 and provides a pushing force outwardly.

The pressing socket 50 is disposed on the sliding guide piece 41 so as to be able to move up and down. The pressing socket 50 has a pressing portion 51 which is pushed against the pressing signal generating unit 331.

The display unit 60 is fixed on the pressing socket 50 and is electrically connected to the circuit board assembly 33. The display unit 60 can be used as a display for a function menu or a display for browsing, such as a web page. In addition, in a further use situation, it can also be replaced with a touch panel, and can be further used as a means of joint control through touch, so that the present invention has integrated control functions.

The keycap 70 is correspondingly placed on the pressing socket 50 and can be rotated around the rotation axis. A transparent plate 71 corresponded to the display unit 60 is disposed on the keycap 70. When the keycap 70 is pressed, the pressing socket 50 is moved downwardly by the keycap 70, and then the pressing signal generating unit 331 is pressed to generate a control signal.

The controlling knob element 80 includes a finger-actuated ring 81, an outer ring sleeve 82, and a signal shielding member 83. The finger-actuated ring 81 is a ring-shaped sheet structure that is fixed above the keycap 70. A finger-actuated groove 811 disposed on the finger-actuated ring 81 allows the user to push and rotate it around the rotation axis. The outer ring sleeve 82 is a ring-shaped pipe, its upper end is correspondingly fixed to the keycap 70, and is correspondingly set on an outer ring of the fixing frame 40. The signal shielding member 83 is a ring-shaped pipe, inserted between the outer ring sleeve 82 and the fixing frame 40, and fixed on the outside ring sleeve 82. A plurality of segmented projections 831 is disposed around and on an inner ring wall surface of the signal shielding member 83. Each of the segmented projection 831 is distributed at an equal angle and is pushed by the elastic pushing piece 42. When the controlling knob element 80 is rotated, the elastic pushing piece 42 may intermittently receive resistance feedback by moving the segmented projections 831, multiple segmented feedback forces are generated. A under wall surface of the signal shielding member 83 further extends into and between each group of the infrared receiving end 3321 and the infrared transmitting end 3322. A plurality of hollow portions 832 are distributed in a ring-shape structure below the signal shielding member 83. When the controlling knob element 80 is rotated and the lower wall surface of the signal shielding member 83 are moved between the infrared receiving end 3321 and the infrared transmitting end 3322, the infrared signal between the infrared receiving end 3321 and the infrared transmitting end 3322 can be intermittently transmitted due to the hollow portion 832, and it can be used to determine the controlling knob element 80 rotating in clockwise or counterclockwise direction and its rotation amplitude, and the control signal is outputted.

The multifunctional push knob of the present invention has a display function on a switch device, and it also provides a pressing signal, a quantifiable left and right rotary control signal, and a left and right rotary control signal of the rotating output element 20 on the switch device. It is a highly integrated control device. For example, it can be used as a quantifiable left and right rotary control signal or selecting function options on a menu. It also can be used to skip to next page or return to previous page by rotating the rotating output element 20 in right or left direction, thereby achieving multifunctional operation modes.

If this device is installed in the car, it can be used as the operation switch of heating and cooling, audio, broadcasting, Bluetooth connection and other equipment. In a fixed space, it would improve the operation functionality and flexibility and allow various controls in the car. The interface can greatly reduce the space, which is non-obvious over the conventional technology.

It will be understood that the above description of embodiments is given by way of example only and that various modifications may be made by those with ordinary skill in the art. The above specification, examples, and data provide a complete description of the present invention and use of exemplary embodiments of the invention. Although various embodiments of the invention have been described above with a certain degree of particularity, or with reference to one or more individual embodiments, those with ordinary skill in the art could make numerous alterations or modifications to the disclosed embodiments without departing from the spirit or scope of this invention.

What is claimed is:

1. A multifunctional push knob, comprising:

a base, including a base plate, an annular conducting member disposed on the base plate, a center of the annular conducting member is a rotation axis, the annular conducting member having an extended conducting pin extended to an outside of the base, a side conducting element is set on both sides of the annular conducting element, wherein the side conducting element has a side extension conducting pin extended to the outside of the base, wherein the base further comprises a tension spring;

a rotating output element, including a main rotation frame, the main rotation frame being a tubular member and correspondingly disposed above the base, and rotated around the axis of rotation, a rotation collar extended outwardly and fixed on the main rotation frame, a spring transmission member disposed at a bottom of the main rotation frame, the spring transmission member corresponding to the tension spring and being reset by a feedback force of the tension spring after the main rotation frame being rotated, a conducting contact member is disposed at the bottom of the main rotation frame, the conducting contact member has a first conducting pin and a second conducting pin, wherein the first conducting pin is abutted upon the annular conducting member, and the second conducting pin contacts with the side conducting element after the main rotation frame is rotated, thereby making the extended conducting pin conduct to the side extension conducting pin;

a connecting socket, including a connecting base, an upper socket, and a circuit board assembly, wherein the connecting base is fixed on the base plate, the upper socket is fixed above the connecting base, the circuit board assembly is correspondingly fixed to an upper wall surface of the upper socket, and the circuit board assembly has a pressing signal generating unit and a plurality of infrared shielding induction signal generating units, wherein the pressing signal generating unit protrudes on the circuit board assembly and has a resilient returning force, the pressing signal generating unit contacts with the circuit board assembly after pushing the pressing signal generating unit, then a control signal is generated, and the plurality of infrared shielding induction signal generating units comprise an infrared receiving end and an infrared transmitting end which are separated and set correspondingly from each other;

a fixing frame, correspondingly fixed above the upper socket, wherein the fixing frame is tubular and has a plurality of sliding guide pieces at a center of the fixing frame;

a pressing socket, disposed on the sliding guide piece so as to be able to move up and down, and the pressing socket having a pressing portion which is pushed against the pressing signal generating unit;

a display unit, fixed on the pressing socket and electrically connected to the circuit board assembly;

a keycap, correspondingly placed on the pressing socket and rotated around the rotation axis, a transparent plate corresponded to the display unit and disposed on the keycap, wherein when the keycap is pressed, the pressing socket is moved downwardly by the keycap, and then the pressing signal generating unit is pressed to generate a control signal; and a controlling knob element, including a finger-actuated ring, an outer ring sleeve, and a signal shielding member, wherein the finger-actuated ring is a ring-shaped sheet structure that is fixed above the keycap, the outer ring sleeve is a ring-shaped pipe, an upper end of the outer ring sleeve is correspondingly fixed to the keycap, and is correspondingly set on an outer ring of the fixing frame, the signal shielding member is a ring-shaped pipe, inserted between the outer ring sleeve and the fixing frame, and fixed on the outside ring sleeve, a under wall surface of the signal shielding member further extends into and between each group of the infrared receiving end and the infrared transmitting end, and a plurality of hollow portions are distributed in a ring-shape structure below the signal shielding member, wherein when the controlling knob element is rotated, an infrared signal between the infrared receiving end and the infrared transmitting end is intermittently transmitted.

2. The multifunctional push knob as defined in claim 1, wherein the base comprises a first rotation limited element, the main rotation frame comprises a second rotation limited element, and the main rotation frame is abutted upon the first rotation limited element after the main rotation frame is rotated toward a rotation angle in the clockwise or counterclockwise direction, thereby limiting a rotation range of the main rotation frame.

3. The multifunctional push knob as defined in claim 1, wherein the fixing frame has a plurality of elastic pushing pieces on an outer wall surface of the fixing frame, and the elastic pushing piece protrudes from the outer wall surface of the fixing frame; a plurality of segmented projections is disposed around and on an inner ring wall surface of the signal shielding member, and each of the segmented projection is distributed at an equal angle and is pushed by the elastic pushing piece, when the controlling knob element is rotated, the elastic pushing piece intermittently receives resistance feedback by moving the segmented projections, and multiple segmented feedback forces are generated.

4. The multifunctional push knob as defined in claim 1, wherein the finger-actuated ring comprises a finger-actuated groove.

* * * * *